US008172637B2

(12) United States Patent
Brown

(10) Patent No.: US 8,172,637 B2
(45) Date of Patent: May 8, 2012

(54) PROGRAMMABLE INTERACTIVE TALKING DEVICE

(75) Inventor: Stephen J. Brown, Woodside, CA (US)

(73) Assignee: Health Hero Network, Inc., Palo Alto, CA (US)

(*) Notice: Subject to any disclaimer, the term of this patent is extended or adjusted under 35 U.S.C. 154(b) by 892 days.

(21) Appl. No.: 12/046,998

(22) Filed: Mar. 12, 2008
(Under 37 CFR 1.47)

(65) Prior Publication Data

US 2009/0275408 A1 Nov. 5, 2009

(51) Int. Cl.
*A63F 9/24* (2006.01)

(52) U.S. Cl. ..... 446/175; 463/35

(58) Field of Classification Search ..... 463/35; 446/268

See application file for complete search history.

(56) References Cited

U.S. PATENT DOCUMENTS

| | | | | |
|---|---|---|---|---|
| 4,840,602 | A | 6/1989 | Rose | |
| 4,846,693 | A | 7/1989 | Baer | |
| 4,857,030 | A | 8/1989 | Rose | |
| 4,923,428 | A | 5/1990 | Curran | |
| 5,029,214 | A | 7/1991 | Hollander | |
| 5,033,864 | A | 7/1991 | Lasecki et al. | |
| 5,376,038 | A | 12/1994 | Arad et al. | |
| 6,048,209 | A | 4/2000 | Bailey | |
| 6,050,826 | A | 4/2000 | Christianson et al. | |
| 6,056,618 | A | 5/2000 | Larian | |
| 6,089,942 | A * | 7/2000 | Chan | 446/175 |
| 6,110,000 | A * | 8/2000 | Ting | 446/302 |
| 6,135,845 | A | 10/2000 | Klimpert et al. | |
| 6,149,490 | A | 11/2000 | Hampton et al. | |
| 6,193,580 | B1 | 2/2001 | Albert et al. | |
| 6,206,745 | B1 | 3/2001 | Gabai et al. | |
| 6,227,931 | B1 | 5/2001 | Shackelford | |
| 6,247,934 | B1 | 6/2001 | Cogliano | |
| 6,257,948 | B1 | 7/2001 | Silva | |
| 6,290,566 | B1 | 9/2001 | Gabai et al. | |
| 6,309,275 | B1 * | 10/2001 | Fong et al. | 446/297 |
| 6,358,111 | B1 | 3/2002 | Fong et al. | |
| 6,361,396 | B1 | 3/2002 | Snyder et al. | |
| 6,364,735 | B1 | 4/2002 | Bristow et al. | |
| 6,375,535 | B1 | 4/2002 | Fong et al. | |
| 6,380,844 | B2 | 4/2002 | Pelekis | |
| 6,394,872 | B1 | 5/2002 | Watanabe et al. | |
| 6,409,511 | B2 | 6/2002 | Cogliano | |
| 6,454,625 | B1 | 9/2002 | Fong et al. | |
| 6,471,420 | B1 * | 10/2002 | Maekawa et al. | 704/250 |
| 6,497,604 | B2 | 12/2002 | Fong et al. | |
| 6,497,606 | B2 | 12/2002 | Fong et al. | |
| 6,497,607 | B1 | 12/2002 | Hampton et al. | |

(Continued)

FOREIGN PATENT DOCUMENTS

WO WO 01/12285 A1 * 2/2001

*Primary Examiner* — Tramar Harper
(74) *Attorney, Agent, or Firm* — Rahman LLC

(57) ABSTRACT

A programmable interactive device in which a microprocessor is coupled to memory and two speech synthesis processor. The device is connected through a wireless communication system to a remote server to receive scripts and corresponding digital data provided by third party content providers and other users. Software is executed to select digital data and the script based on received identification data and status data from an adjacent device. A code of instructions is executed on the microprocessor to activate a speech synthesizer to convert digital data into audio data, which is output through a speaker. Also, an interactive environment for a pair of talking devices is provided.

19 Claims, 5 Drawing Sheets

U.S. PATENT DOCUMENTS 6,514,117 B1 2/2003 Hampton et al.
6,527,611 B2 3/2003 Cummings
6,537,128 B1 3/2003 Hampton et al.
6,544,098 B1 4/2003 Hampton et al.
6,551,165 B2 * 4/2003 Smirnov ..... 446/175
6,554,679 B1 4/2003 Shackelford et al.
6,565,407 B1 5/2003 Woolington et al.
6,572,431 B1 6/2003 Maa
6,585,556 B2 7/2003 Smirnov et al.
6,607,388 B2 8/2003 Cogliano
6,609,943 B1 8/2003 Chan
6,631,351 B1 * 10/2003 Ramachandran et al. .... 704/270
6,641,401 B2 11/2003 Wood et al.
6,641,454 B2 11/2003 Fong et al.
6,663,393 B1 * 12/2003 Ghaly ..... 434/262
6,682,387 B2 * 1/2004 Choi ..... 446/175
6,682,390 B2 1/2004 Saito
6,692,328 B1 2/2004 Reinberg et al.
6,699,045 B2 3/2004 Christianson et al.
6,702,644 B1 3/2004 Hornsby et al.
6,729,934 B1 5/2004 Driscoll et al.
6,736,694 B2 5/2004 Hornsby et al.
6,761,637 B2 7/2004 Weston et al.
6,773,322 B2 8/2004 Gabai et al.
6,773,344 B1 8/2004 Gabai et al.
6,847,892 B2 1/2005 Zhou et al.
6,949,003 B2 9/2005 Hornsby et al.
6,959,166 B1 10/2005 Gabai et al.
6,995,680 B2 2/2006 Fong
7,033,243 B2 4/2006 Hornsby et al.
7,035,583 B2 4/2006 Ferrigno et al.
7,066,781 B2 6/2006 Weston
7,068,941 B2 6/2006 Fong et al.
7,568,963 B1 * 8/2009 Atsmon et al. ..... 446/175
2006/0229810 A1 10/2006 Cross et al.
2008/0160877 A1 * 7/2008 Lipman ..... 446/268
2010/0041304 A1 * 2/2010 Eisenson ..... 446/297

* cited by examiner

500

| Category | Dog | Cat | Mouse |
|---|---|---|---|
| Greeting | | | |
| Chasing | | | |
| Scratching | | | |
| Petting | | | |
| Friends | | | |

FIG. 5

PROGRAMMABLE INTERACTIVE TALKING DEVICE

BACKGROUND

1. Technical Field

The embodiments herein generally relate to toys, and more specifically to an interactive toy, which is programmed to talk and respond with respect to speech emitted by a nearby device or toy.

2. Description of the Related Art

Generally toys are considered as objects for play and entertainment. They provide entertainment not only to children but also to pets such as dogs, cats, etc. Recently, toys have taken a new dimension to serve people with a variety of purposes. Toys and other devices such as robots are also currently used to provide education, to impart training to individuals, and to improve the language skills of the individuals. Children use toys and play with devices to discover their identity, help their body grow strong, learn cause and effect, explore relationships, and practice skills. These toys and other devices are also used by adults and pets interactively to reduce boredom and solitude. Currently available toys tend to have a limited capability for interacting with a user. The toys react mostly based on a manual input by a user. In other words, toys tend to interact passively and not actively and dynamically. Moreover, toys emit speech or sound based on some physical stimuli and are generally made to emit some stored text but do not provide an intelligent conversation with a user. Furthermore, toys are not generally programmed with a script generated by a user or with content created by a wide variety of third party content providers or with downloaded content.

Accordingly, there is a need to develop a programmable, interactive talking toy device which is programmed to respond and emit text generated by a user or the text created by a third party service provider or by the script downloaded from an internet or server in order to dynamically interact with the responses made by a nearby device or user intelligently.

SUMMARY

In view of the foregoing, the embodiments herein provide an interactive device which can be programmed with a variety of scripted conversations provided by a user or by a third party content provider, which can be downloaded to the device from a server. Additionally, the embodiments herein provide an interactive talking environment to a device with respect to another adjacent device or with a user. Furthermore, the embodiments herein provide a talking device with a recorded speech or speech synthesized to output pre-programmed statements upon activation by a user. Also, the embodiments herein provide a talking device, which can be programmed with a script that may be modified by a user or with a script downloaded from a remote server computer. Moreover, the embodiments herein provide a plurality of interactive devices that can interact with one another dynamically.

The embodiments herein further provide a plurality of talking devices in which scripted speech is output in response to a speech output from an adjacent device, when one device is activated by a user. Additionally, the embodiments herein provide a device, which can be programmed by a user through a personal computer or mobile telephone or television to provide a desired conversation script. Furthermore, the embodiments herein provide an interactive programmable device in which a user can upload a generated conversation script to remote server computer for sharing with other users. Additionally, the embodiments herein provide an interactive programmable device in which a user can download a script generated by others and program the downloaded script into a pair of talking devices. Moreover, the embodiments herein provide an interactive programmable device in which one script of the device becomes an input variable for the script on the adjacent device More particularly, the embodiment herein provides an interactive programmable device that has a memory unit adapted to store the data modules, which can be synthesized into speech and a microprocessor based speech module, which is connected to the memory and to a transceiver. The transceiver receives an identification data and a status data from an adjacent device. A remote server computer is operatively connected to a programmable device through a wireless communication system and is provided with a database to store digital data modules and scripts that are either input by a user or downloaded from a third party content provider. Software is operated on the remote server computer to provide the third party content and the scripts. The interactive programmable device receives the digital data modules and scripts from a server computer through wireless communication system and stores received digital data modules and the scripts in the memory. A software program is operated on the interactive programmable device to select a stored digital data module corresponding to a stored script from the memory based on the received identification data and status data from an adjacent device. A set of instructions are executed on a microprocessor for synthesizing digital data modules acquired from memory with respect to received identification data and the status data of the adjacent device.

The embodiments herein also provide an interactive talking device environment comprising of at least two interactive devices, which dynamically and intelligently interact with one another. Search rules for response script of second device are based on adjacent device script category. The script of adjacent device contains identity and categorization metadata that becomes an input variable for the script on the second device.

The embodiments herein provide an operating method for a programmable interactive talking toy. A sensor is activated to detect the status of an adjacent toy. The detected data are transmitted to a remote server through a Bluetooth™ communication system. A software program is operated on the remote server to select a suitable response script from a stored script table based on the received status data of the adjacent toy. The script table contains the data contents loaded from other service providers or the contents generated by third party. The selected response script is forwarded to the programmable talking toy. A speech processor analyses the received script to generate a corresponding voice message which is output through the speaker.

These and other embodiments herein are understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which:

FIG. 5 shows an example of a script data table according to an embodiment herein.

DETAILED DESCRIPTION OF THE PREFERRED EMBODIMENTS

Figure 1:
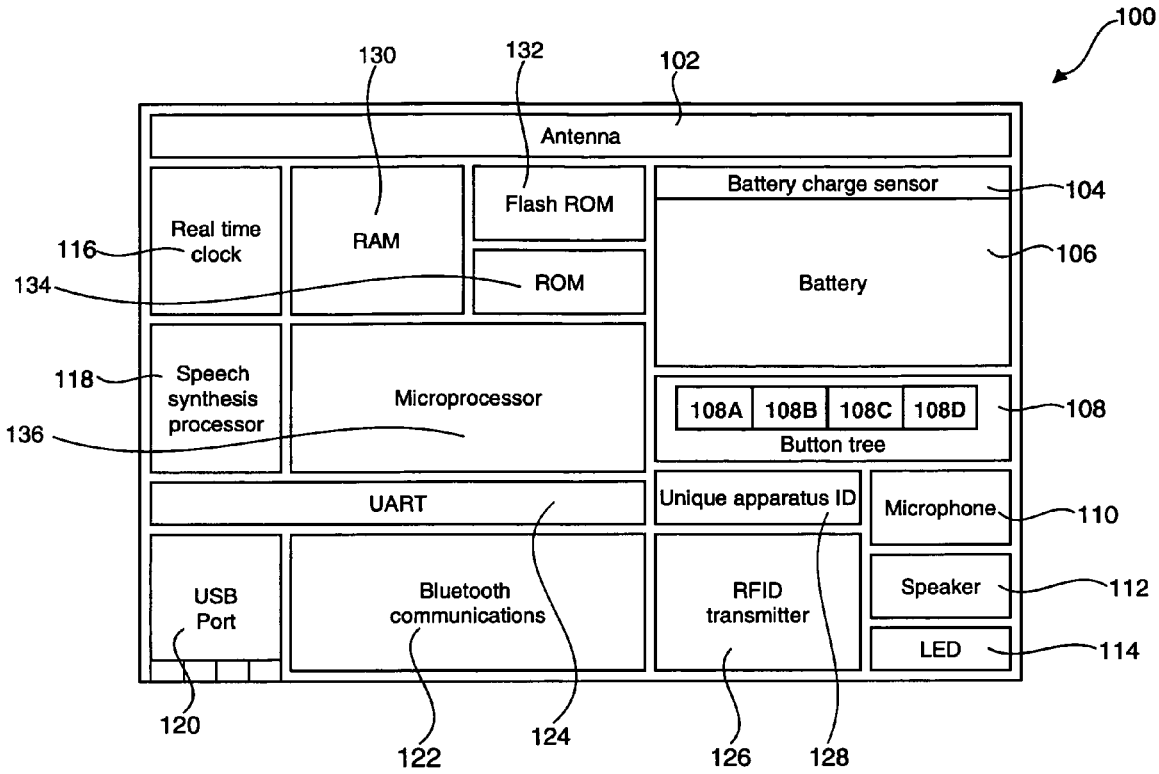
FIG. 1 shows a block diagram of an embedded device module according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a novel programmable, interactive talking toy device. The embodiments herein achieve this by providing an interactive programmable device. The device has a memory and a microprocessor based speech synthesis module that is connected to the memory and to a transceiver. The memory stores the data modules, which can be synthesized into speech. Referring now to the drawings, and more particularly to FIGS. 1 through 5, where similar reference characters denote corresponding features consistently throughout the figures, there are shown preferred embodiments.

FIG. 1 illustrates a block diagram of the components an embedded device module 100 according to an embodiment herein. The device module 100 has a microprocessor 136 operatively connected to a speech synthesis processor 118 and to memory units such as ROM 134, RAM 130 and flash ROM 132. The memory units store digital data modules and scripts received from a remote server computer 204 (shown in FIGS. 2 and 3) through a wireless communication system 122 such as a Bluetooth™ communication device. The wireless communication system 122 is also used to receive a sensor signal or a radio frequency (RF) signal containing a device identification data and a status data from an adjacent device (not shown). The speech emitted by the adjacent device is received by a microphone 110. A user inputs data and activates the device module 100 through buttons 108A-108D provided in a button tree 108. A software program or a set of instructions stored in the memory units is executed to select a script and a corresponding digital data module stored in the memory data module with respect to received audio data through microphone 110 or based on the received RF signal from the adjacent device through an antenna 102. A set of stored instructions containing the commands are executed on microprocessor 136 to operate a speech synthesizer processor 118 to synthesize the selected digital data modules from the stored digital data modules in the memory with respect to the received identification data and the status data of the adjacent device, to generate an audio data which is output through a speaker 112 as a response to the speech emitted from an adjacent device.

The device 100 has an antenna 102 to receive RF signals containing device identification data and status data from an adjacent device. Device module 100 further includes a universal serial bus (USB) port 120 through which a flash memory drive storing a digital data module and a script generated by others is coupled. The functional components in the module are supplied with an electrical power provided from a battery 106. A battery charge sensor 104 detects the residual charge in battery 106 and the detected residual battery charge condition is displayed through a LED display 114. The collected data from the adjacent device and the script from an application server are time and date stamped with the data obtained from the real time clock 116. An RFID transmitter 126 forwards the device identification data acquired from a unique device ID 128. A universal asynchronous receiver transmitter 124 (UART) is a transceiver which communicates the data between the various functional units and a microprocessor 136. The UART 124 is used to execute a serial communication between the microprocessor 136 and the devices connected to the USB port 120. The devices connected to the USB port 120 may include a flash memory drive, an adjacent toy, a detection sensor, etc.

Figure 2:
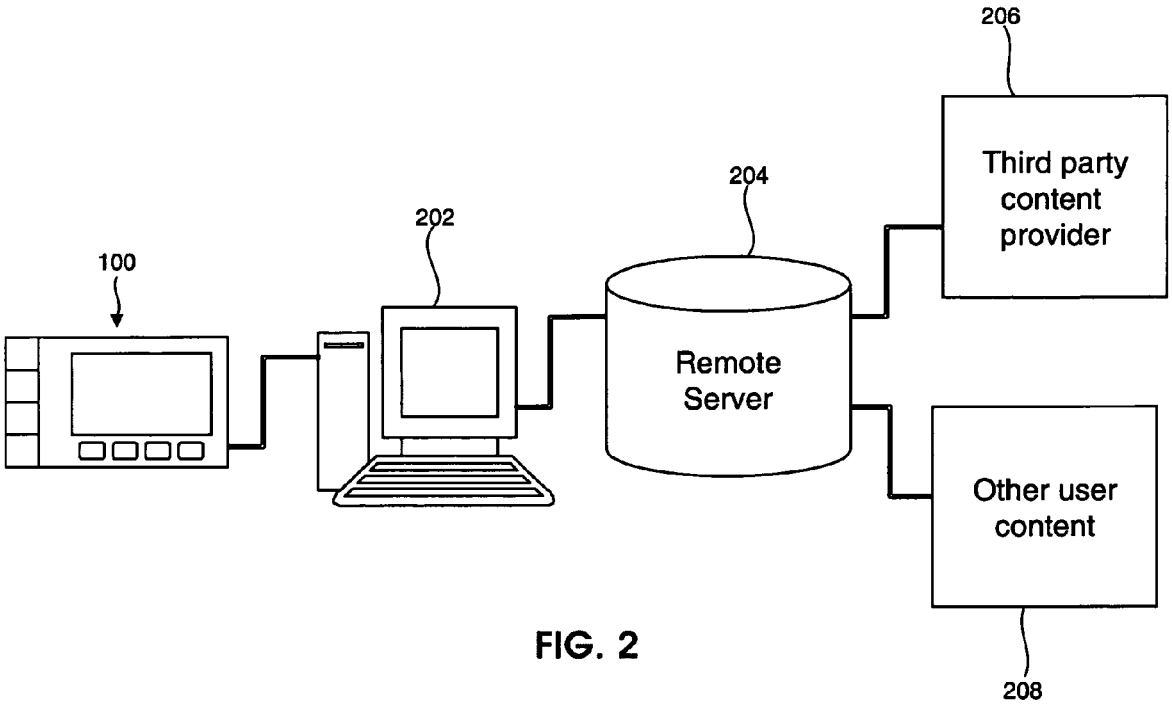
FIG. 2 shows a block diagram of a system for remote programming and exchange of scripts in a programmable interactive device connected to a remote server through a personal computer according to an embodiment herein.

FIG. 2 shows a block diagram of the programmable interactive device 100 of FIG. 1, which is connected to a remote server computer 204 through a personal computer 202. Software is operated in the remote server computer 204 to receive scripts and their respective digital data modules from a third party content provider 206 or the contents generated by other users 208. The received contents and the scripts are stored in a database (not shown) at the remote server 204.

Figure 3:
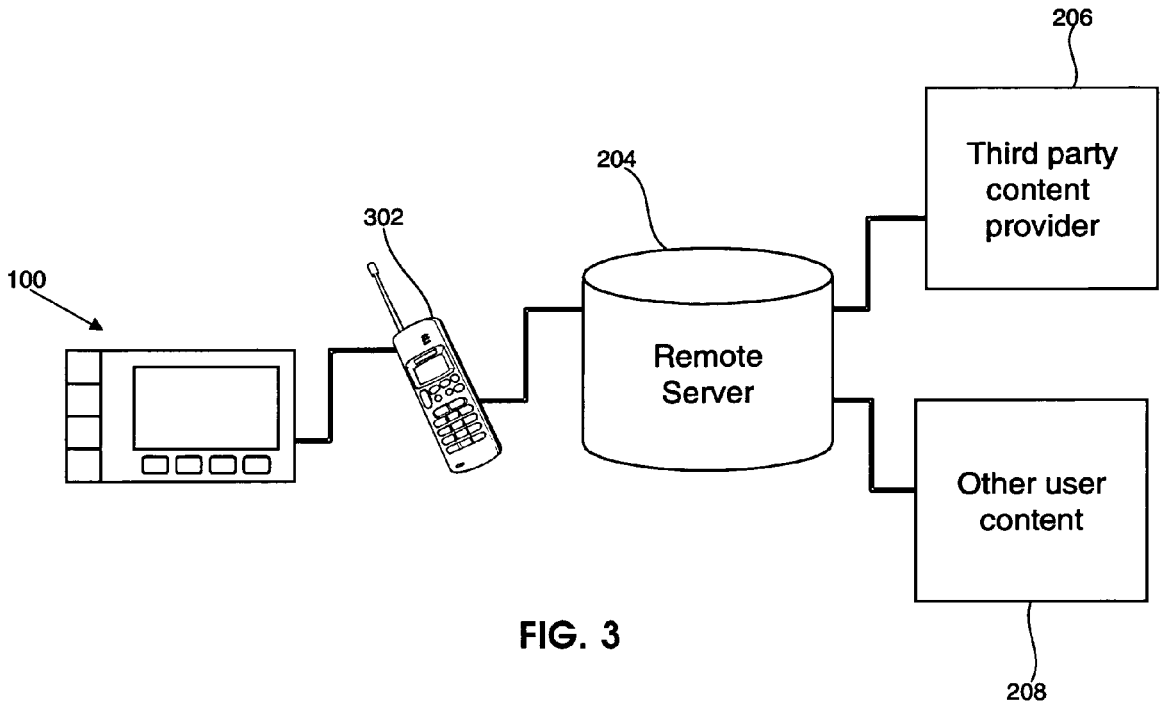
FIG. 3 shows a block diagram of a system for remote programming and exchange of scripts in a programmable interactive device connected to remote server through a mobile telephone according to an embodiment herein.

FIG. 3 shows a block diagram of the programmable interactive device 100 of FIG. 1, which is connected to a remote server computer 204 through a mobile telephone 302 to receive the script and digital data modules from a third party content provider 206 or scripts and digital data modules generated by other users 208. A pager or any other personal communication device can be used in the place of mobile telephone 302 to communicatively couple the interactive programmable device 100 with a remote server computer 204.

Figure 4:
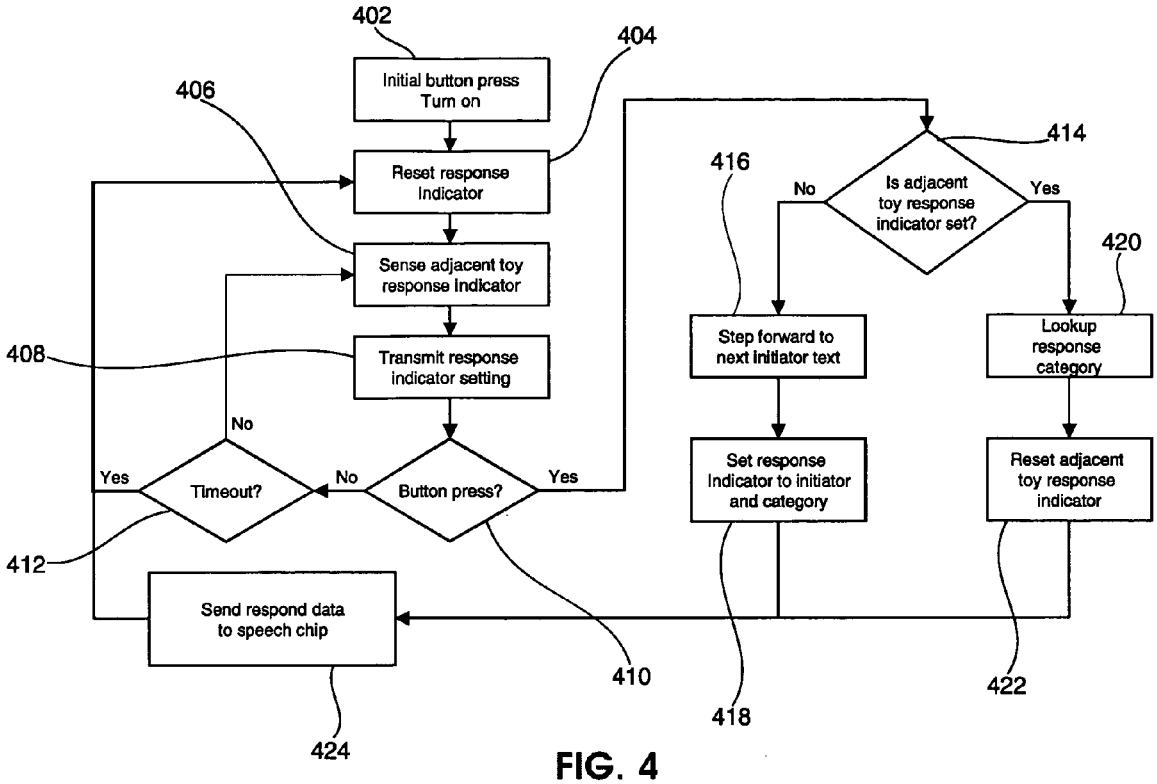
FIG. 4 shows a flowchart illustrating the interactive dialogue operation in a programmable interactive device according to an embodiment herein.

FIG. 4 is a flowchart illustrating the operation of the programmable interactive device 100 of FIGS. 1 through 3. The device 100 is turned on by pressing (402) an initial button (not shown). Then, a response indicator is reset (404). The response of the adjacent device response for a reaction from one device is then sensed (406). Next, the set response is transmitted (408). After receiving the transmitted response, a button is pressed (410) by a user to activate an interactive device. The activation of the button is detected. When the button is not activated and the elapsed time for button activation is more than preset time, then the output response indicator is reset (412). When the button is not activated and the elapsed time is within a preset time, the response of the adjacent device is sensed (406). Alternatively, when the button is activated, the setting of an adjacent device indicator is detected (414). When the adjacent device response indicator is not set after the activation of the button by a user, the next conversation initiator text is output (416). Then, the response of a device is set (418) to an initiator unit and category and a response data is sent (424) to a speech chip. When the adjacent device response indicator is set after the activation of a button, a suitable response is looked for (420). Then, the adjacent device response indicator is reset (422) to send a response data to a speech chip.

FIG. 5 shows an example of script data table 500. Search rules for response script of the second device are based on an adjacent device script category. The script commands illustrated in table 500 are examples, and the embodiments herein are not limited to these particular script commands. The script data table 500 includes category of conversation script. The software executes conversation script so that next statement of the device becomes responsive to adjacent device's status and script. The script of adjacent device becomes an input variable for the script on the second device. The embodiments herein are capable of generating multiple script programs; e.g., a script program for chasing, a script program for playing, etc. A script generating software program is operated on the interactive programmable device to select a stored script from the script template included in a script data table based on the input data from the sensor module and the speech synthesizer. A stored digital data module corresponding to the selected script is retrieved from the memory based on the received identification data and the status data from an adjacent device. A set of instructions are executed on the microprocessor based speech synthesizer for synthesizing the digital data modules acquired from the memory with respect to the received identification data and the status data of the adjacent device. The set of instructions may contain codes or commands to execute a speech synthesizing algorithm or the set of instructions can also be a software program for performing a speech synthesizer process. A speech generator is adapted to produce a speech based on the digital data acquired with respect to the speech emitted by the adjacent device to create a simulated conversation between the two devices, when one device is activated by a user after detecting the speech from another device with a sensor. The interactive devices are programmed with a variety of scripted conversations by the user or by third party content providers.

The embodiments herein provide an interactive talking device 100 with recorded speech or a speech synthesizer 118 to emit pre programmed statements upon activation by a user. An interactive talking device could be programmed with a script that could be identified by a user or with a downloaded script from the remote server 204. The interactive talking device is made to output a scripted speech in response to the speech of an adjacent device when the device is activated by a user. The interactive device can be programmed by a user through a personal computer 202, mobile telephone 302, or television (not shown) to provide a desired conversation. The embodiments herein enable users to upload a self-authored conversation to a remote server computer 204 for sharing with other users. Moreover, the embodiments herein further enable the users to download conversation scripts authored by other users 208 and to program the downloaded scripts into a pair of talking devices (not shown). Thus, the embodiments herein provide a dynamic talking environment for a plurality of devices to talk with one another.

The programmable interactive talking device 100 may be used as an educational toy to help students and children to learn a language or any foreign language or any topic of interest. Furthermore, the programmable interactive talking device 100 also may be used as an entertainment toy. The device 100 further comprises a sensor (not shown) to detect an adjacent device. In one embodiment, the sensor may be a Radio Frequency Identification device (RFID) interrogator (not shown), which detects and reads the data contained in the RFID provided in an adjacent device. In another embodiment, the device 100 may be a Bluetooth™ communications device which receives a RF signal emitted by an adjacent device. The radio frequency signal emitted by the adjacent device contains the identification data of the device and the status data of the device.

A transceiver (not shown) receives an identification data and a status data from the adjacent device. Furthermore, the remote server computer 204 is operatively connected to the programmable device 100 through the wireless communication system 122 and the remote server 204 is provided with a database (not shown) to store digital data modules and scripts that are either input by a user 208 or downloaded from a third party content provider 206. A software program is operated on the remote server computer 204 to provide the third party contents and the scripts. The interactive programmable device 100 receives the digital data modules and the scripts from the server computer 204 through the wireless communication system 122 and stores the received digital data modules and the scripts in the memory units of the device 100. The programmable script can be modified by the user and can be stored by the user in a computer such as the remote server computer 204. The scripts for a pair of interactive devices can be programmed by the user via a personal computer 202, mobile phone 302, television (not shown), or any other appropriate communication device. The scripts are uploaded and downloaded by the user from the remote server computer 204. Furthermore, the conversation scripts are accessible to other users for sharing.

A software program is operated on the interactive programmable device 100 to select a stored digital data module corresponding to a stored script from the memory based on the received identification data and the status data from an adjacent device. A set of instructions are executed on the microprocessor based speech synthesizer 118 for synthesizing the digital data modules acquired from the memory with respect to the received identification data and the status data of the adjacent device. The set of instructions may contain codes or commands to execute a speech synthesizing algorithm or the set of instructions can also be a software program for performing a speech synthesizer process. The interactive device 100 is adapted to respond to the speech of adjacent device to create a simulated conversation between the devices when the device 100 is activated by a user after detecting speech from another device with a sensor. The interactive devices 100 are programmed with a variety of scripted conversations by the user or by third party content providers.

Another embodiment provides an interactive talking device environment comprising of at least two interactive devices (not shown). Each device 100 has a memory for storing data, which can be synthesized into speech modules and a speech synthesis processor 118 for converting digital data into a speech module. A microprocessor 136 is connected to the speech synthesis processor, the memory, and to a transceiver (not shown). A sensor is provided to identify an adjacent device. A user activates the device 100 based on the detected sensor signal indicating the presence and the response of the adjacent device to provide a response with respect to the speech from the adjacent device. Software is executed to provide a responsive conversation script according to adjacent device status and script.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. An interactive programmable device comprising:

a wireless communication device that receives digital data modules and computer programmable scripts;

a memory unit that stores said digital data modules and a plurality of computer programmable scripts;

a computerized speech module that executes at least one of said computer programmable scripts stored in said memory unit and synthesizes said digital data modules into speech;

a sensor that identifies and detects a status of an adjacent interactive programmable device;

a transceiver operatively connected to said sensor that receives identification and status information of the adjacent device from said sensor and transmits said identification and status information to a remote application server, wherein the remote application server transmits a response script and corresponding digital data modules to the wireless communication device based on said identification and status information;

a software module stored on said memory unit, wherein said software module inputs said response script and corresponding digital data modules into said computerized speech module for synthesis into speech; and a speaker to output said speech.

2. The interactive programmable device of claim 1, wherein said computer programmable scripts are configured to be modified by a user.

3. The interactive programmable device of claim 1, further comprising a button that allows said interactive programmable device to be activated by a user to create a simulated conversation between a plurality of interactive programmable devices in response to the speech of said adjacent device, wherein a script of said adjacent device contains identity and categorization metadata that becomes an input variable for the script on said interactive programmable device.

4. The interactive programmable device of claim 1, wherein said interactive programmable device is a toy.

5. An interactive talking system comprising a first interactive programmable device adjacent to a second interactive programmable device, wherein each interactive programmable device comprises:

a wireless communication transceiver that receives digital data modules and computer programmable scripts;

a memory unit that stores said digital data modules and a plurality of computer programmable scripts;

a computerized speech module that executes at least one of said computer programmable scripts received through said wireless communication transceiver and stored in said memory unit and synthesizes said digital data modules into speech;

a sensor that identifies and detects a status of the adjacent interactive programmable device;

a transceiver operatively connected to said sensor, wherein said transceiver receives identification and status information of the adjacent interactive programmable device from said sensor and transmits said identification and status information to a remote application server, wherein the remote application server transmits a response script and corresponding digital data modules to the wireless communication transceiver based on said identification and status information;

a software module stored on said memory unit, wherein said software module inputs said response script and corresponding digital data modules into said computerized speech module for synthesis into speech; and a speaker to output said speech.

6. The system of claim 5, further comprising a communications network that facilitates data transfer and interaction between the first and second interactive programmable devices.

7. The system of claim 5, wherein said first interactive programmable device is responsive to the speech of said second interactive programmable device once said first interactive programmable device is activated by a user to create a simulated conversation between the first and second devices.

8. The system of claim 5, wherein said first interactive programmable device generates a response computer programmable script based on a computer programmable script category of said second interactive programmable device.

9. The system of claim 5, wherein the first and second interactive programmable devices each sense proximity to other devices and responds with appropriate speech to have a simulated conversation with other devices.

10. The system of claim 5, wherein the first and second devices each comprise computer-executable programs comprising scripted conversations generated by any of a user and a third party content provider.

11. The system of claim 10, wherein said computerized speech module selects an appropriate scripted response based on a proximity the devices.

12. The system of claim 5, further comprising a communications device connecting each of said devices to said remote application server.

13. The system of claim 12, wherein said communications device comprises any of a computer, a telephone, and a television.

14. The system of claim 5, wherein the devices are toys.

15. A method for operating a programmable interactive device, said method comprising:

receiving, in said programmable interactive device, digital data modules and computer programmable scripts from a remote application server;

activating a sensor provided in said programmable interactive device to detect speech and a status of an adjacent programmable interactive device;

converting the detected speech and status into data;

transmitting said data to said remote application server in order to receive a response script;

processing said received response script with a speech processor in order to output an audio speech response; and outputting said audio speech response.

16. The method of claim 15, wherein said sensor comprises a RFID interrogator that receives and detects an identity of said adjacent programmable interactive device.

17. The method of claim 15, further comprising operating a software program stored in said remote application server that selects a response script stored in a scripted table based on the detected speech and status of said adjacent programmable interactive device.

18. The method of claim 15, wherein said response script is generated by a third party content provider and uploaded to said remote application server.

19. The method of claim 15, wherein a voice message corresponding to a selected response script is output through a speaker on said interactive programmable device as a response.

* * * * *